United States Patent [19]

Peterson

[11] Patent Number: 4,505,058

[45] Date of Patent: Mar. 19, 1985

[54] EXCAVATING TOOTH, HOLDER AND RETAINER

[76] Inventor: Gerald A. Peterson, 37 Sullivan Dr., Moraga, Calif. 94556

[21] Appl. No.: 578,201

[22] Filed: Feb. 8, 1984

Related U.S. Application Data

[63] Continuation-in-part of Ser. No. 445,971, Jan. 6, 1983, abandoned.

[51] Int. Cl.[3] ..... E02F 9/28

[52] U.S. Cl. ..... 37/142 A; 24/580; 24/612; 403/13; 403/155; 403/324; 403/326; 411/353; 411/517; 411/530

[58] Field of Search ..... 37/142 A, 142 R, 141 R, 37/141 T; 403/13, 155, 317, 324, 326; 411/516, 517, 522, 530, 352, 353; 24/211 L, 612, 211 R, 580; 299/92; 172/713

[56] References Cited

U.S. PATENT DOCUMENTS

| | | | |
|---|---|---|---|
| 3,144,909 | 8/1964 | Hart et al. | 37/142 A X |
| 3,826,024 | 7/1974 | Petersen | 37/142 A |
| 4,050,172 | 9/1977 | Petersen | 37/142 A |
| 4,367,602 | 1/1983 | Petersen | 37/142 A |

*Primary Examiner*—Edgar S. Burr
*Assistant Examiner*—Moshe I. Cohen
*Attorney, Agent, or Firm*—Julian Caplan

[57] ABSTRACT

An excavating tooth has a blade of substantially constant thickness with a transverse shoulder at its inner end and a longitudinal gusset. The tooth terminates in a reduced diameter spindle and a button with a shoulder on its forward face. The adapter has a recess to receive the tooth, the forward end of the adapter receiving the thrust of the tooth because the transverse shoulder bears thereagainst. A top to bottom opening in the adapter intersects the recess at the spindle. A pair of grooves are formed on the outside edges of the opening with projections extending inward from the outer walls of the grooves. A retainer is formed of round cross-section wire and slides in the grooves between locked and unlocked positions, the diameter of the wire being less than the width of the grooves. The retainer is symmetrical about its longitudinal center line, having a slightly upward bowed top connector and legs depending from either end of the connector. Each leg has, in order, a reverse bend joining the leg to the connector, an upper straight section, an outward-downward slanted section, a lower straight section and a lower terminal.

3 Claims, 6 Drawing Figures

EXCAVATING TOOTH, HOLDER AND RETAINER

This application is a continuation-in-Part of applications Ser. No. 06/455,971, filed Jan. 6, 1983, now abandoned.

This invention relates to a new and improved excavating tooth, holder and retainer. Reference is made to prior U.S. Pat. Nos. 3,751,834; 3,826,024 and 4,050,172, on which this application is an improvement. This application is also an improvement upon co-pending application Ser. No. 06/310,472, filed Oct. 13, 1981, now U.S. Pat. No. 4,367,602.

Many of the advantages and distinctions over prior art of the present invention are set forth in the above identified patents and are not repeated herein.

At the present time, commercially available excavating teeth, holders and retainers for heavy equipment (e.g., large bulldozers, dipper buckets, drag line equipment, dumpsters, and the like), as distinguished from smaller equipment (such as earth augers, trenching mechines and the like) are complicated, expensive and difficult to install. However, the use of the present invention is not intended to be confined solely to large equipment.

The systems most widely used at present in heavy equipment are known as "pocketed" teeth, wherein the adapter permanently fixed to the equipment has a forwardly tapering point which fits into a socket or pocket in the excavating tooth and is held therein usually by a composite pin driven transversely through holes in the walls of the pocket and the point of the adapter. The composite retainer usually has some sort of resilient material, such as artificial rubber incorporated therein.

The present invention has numerous advantages over such prior commercially available teeth.

In the first place, the tooth of the present invention is a flat forged tooth. Two teeth may be forged point to point and separated during the final trim forging operation, thereby reducing forging time by one-half, as compared with forging teeth one at a time. Only three forging operations are required as contrasted with forged pocket-type teeth which require more forging steps. This is an important cost advantage. Cast teeth, also commonly used, cost more per unit of weight than forgings. Additionally, forged teeth have superior strength to cast teeth.

An additional feature of the teeth of the present invention is that the cutting portion of the tooth has the same thickness from near the point of the tooth to the shoulder at the rear. As previously mentioned, conventional teeth are generally V-shaped and become blunt as they wear down.

The present invention also has a gusset or rib along the top of the blade of the tooth which gives added strength and also functions as a ripper in certain excavating operations. Use of the gusset in the present invention does not increase the required size of the billet from which the tooth is forged, since the material forming the gusset would otherwise be trimmed off of the tooth as flash during the trimming forging operation.

Another important feature of the present teeth is the transverse shoulder at the rear of the cutting edge, which performs several functions. It transmits the thrust of the tooth directly to the front edge of adapter and hence no strain is placed on the retainer, which holds the tooth in the adapter during normal excavating operations. Hence, the retainer does not have to be constructed as rugged as in conventional systems where the retainer transmits all or a substantial part of the thrust from the tooth to the adapter.

The shoulder of the tooth also shields the adapter from wear and makes replacement of adapters unnecessary. In pocketed teeth, when the tooth wears down, the nose of the adapter which fits into the pocket of the tooth may be exposed and worn away, requiring replacement. Replacement of adapters is an expensive operation, not only from the standpoint of time and materials, but also from the standpoint of down time of the equipment.

Still another advantage of the shoulder on the rear of the tooth of the present invention is that, when the tooth's blade is worn, the tooth simply quits digging. This makes it unnecessary for the operator to check the condition of the teeth frequently, since it is apparent that when the tooth stops cutting that the tooth must be replaced. This reduces the number of times that the operator is required to climb down from the cab of the equipment to check the teeth.

The adapter of the present invention also has advantages over conventional systems. As has been stated, there is no protruding nose on the adapter such as those required in pocket-type teeth and this reduces the weight and fabricating costs of the adapter. Additionally, since the shoulder on the tooth protects the adapter and since the tooth construction prevents use of the equipment when worn, the tendency to wear out adapters is not present in the instant construction.

The retainer of the present invention differs in a number of respects from that shown in previous patents of the inventor. One distinction is that the retainer is a single piece of round cross-section stainless steel, as distinguished from the rectangular cross-section retainers of the above mentioned patents.

A suitable stainless steel wire is 0.187" diameter No. 302 stainless steel. Such material is readily available and easily fabricated.

The retainer is capable of withstanding wide temperature ranges, so that the equipment may be used in sub-freezing temperature conditions or, on the other hand, may be used on a bulldozer for slag in a steel mill.

Fabrication of the retainer is greatly reduced over all prior retainers with which the inventor is familiar. Tooling costs for fabrication of the retainer are modest and the material required is minimal as compared with conventional retainers for heavy duty equipment.

Additionally, the retainer is reusable. Under normal operating conditions, whenever it is necessary to replace a tooth, the retainer is pried up from its locked position in the adapter using a screwdriver. However, the adapter is not fully removed, but is retained in the adapter. It is merely necessary to tap the retainer down in place after a new tooth has been installed, using a hammer. Hence, the time required to replace the tooth is greatly reduced over prior systems. Some prior systems require the use of a drift pin and a sledge; the contrast over the present system is readily apparent.

Since the retainer is not normally removed from the adapter, the danger of it becoming lost while a tooth is being replaced is obviated. Since, in accordance with the present invention, the retainer is symmetrical, the necessity of inserting it in the adapter in a particular orientation is eliminated in accordance with the present invention.

Further, the construction of the retainer is such that it may be installed in the adapter simply by compressing the legs of the hairpin shaped retainer together, so that the points of the hairpin fit into the pocket in the adapter. This operation is most conveniently performed by using a convential pliers.

As is apparent from the following description, an important feature of this invention is that the retainer takes no thrust during the transmission of the thrust from the tooth to the adapter. The function of the retainer is to keep the tooth from falling out of the holder, either from the effects of gravity or in the event that the earth being excavated (e.g., clay) tends to hold the tooth back when the digging equipment is being withdrawn.

Other objects of the present invention will become apparent upon reading the following specification and referring to the accompanying drawings in which similar characters of reference represent corresponding parts in each of the several views.

Figure 1:
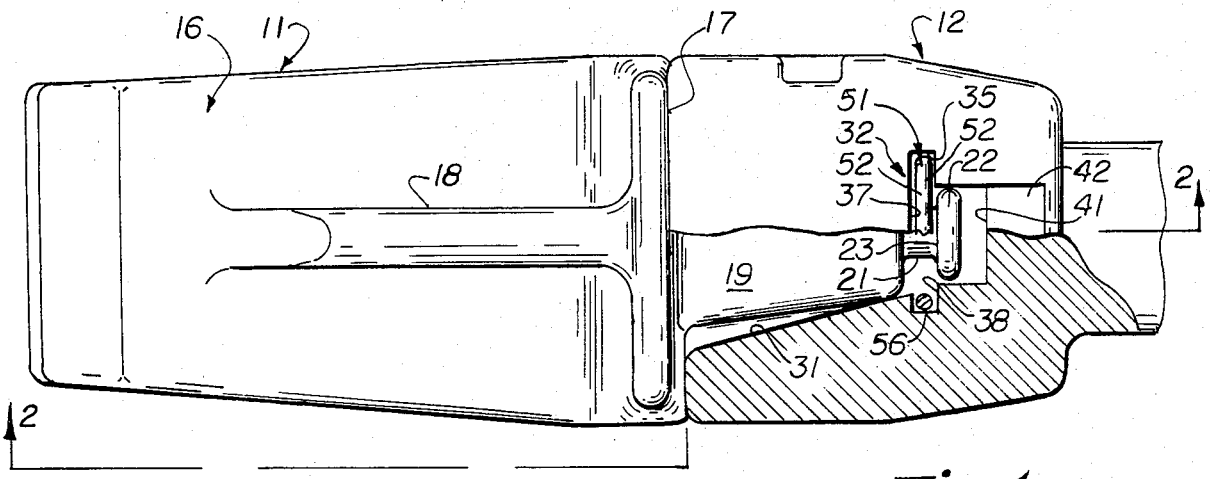
FIG. 1 is a top plan of the tooth, a portion of the adapter and the retainer, partially broken away to reveal internal construction.

Some of the structure of the tooth, holder and retainer of the present invention resemble those of the aforementioned prior patents and are not herein illustrated or described in precise detail. Tooth 11 is held in an adapter 12 attached by conventional means to the leading edge of a piece of construction equipment (not shown) by any well-known means. Tooth 11, as has been mentioned, is preferably forged and its blade 24 preferably has substantially the same thickness from tip to rear, as distinguished from the blades of pocketed teeth which taper outwardly-rearwardly. The distal portion 16 of tooth 11 has a transverse shoulder 17 which bears against the front edge 28 of adapter 11 and transmits normal thrust of the tooth directly to the adapter 12. A longitudinal centrally disposed gusset 18 strengthens the tooth and, where required, may perform a ripping function.

Figure 3:
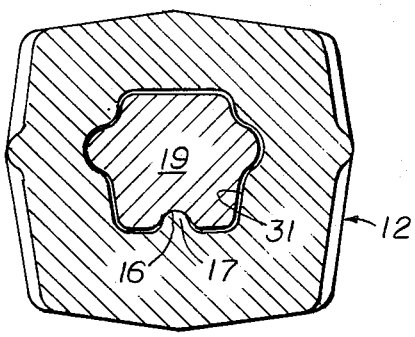
FIG. 3 is a transverse sectional view taken substantially along the line 3—3 of FIG. 2.

The proximal portion of the tooth 11 has a shank 19 which is preferably non-circular as best shown in FIG. 3 and may have means such as the groove 16 which receives longitudinal rib 17 of adapter 12 to prevent the operator from inserting the tooth 11 in the adapter 12 in the wrong orientation.

A reduced width portion 21, or spindle, is formed behind the shank 19 and behind the spindle 21 is a button 22 of larger width than the spindle 21 which has a front shoulder 23.

Adapter 12 is formed with a recess 31 complementary to shank 19 and preferably rearwardly-inwardly tapering. In registry with the spindle 21 is a transverse opening 32 extending in the preferred embodiment shown in the drawings from top to bottom but, as will be understood, which may extend transversely through the adapter 12 in other directions.

Figure 4:
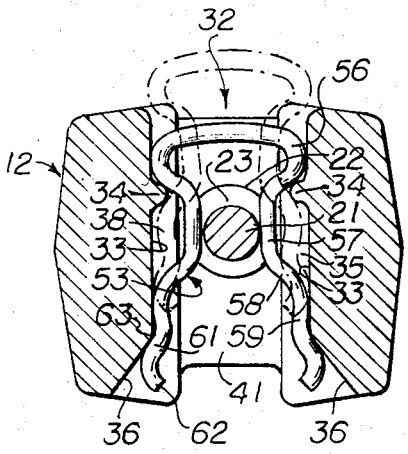
FIG. 4 is a transverse sectional view taken substantially along the line 4—4 of FIG. 2, showing the retainer in locked position in solid lines and in retracted position in dot-and-dash lines.

Opening 32 primarily is intended to receive the retainer 51, so that it may slide from the operative or locked position shown in solid lines in FIG. 4 to the unlocked position shown in dot-and-dash lines. For such purpose there are opposed grooves 35 on either side of opening 32 opposite spindle 21 having side walls 33 which are generally vertical, having inward projections 34 spaced downwardly from the top of the adapter 12 above the level of the spindle 21 of tooth 11. The function of projections 34 hereinafter appears. Side walls 34 above and below projections 34 are co-planar. At the bottom of the opening 32, the walls 33 flare outwardly at about 45° as indicated by reference numerals 36. Front walls 37 and rear walls 38 of the opening 32 are spaced apart a distance slightly greater than the thickness of the retainer 51 when thrust is applied to the tooth. Further, retainer 51 is slightly forward of shoulder 23 of button 22.

Figure 2:
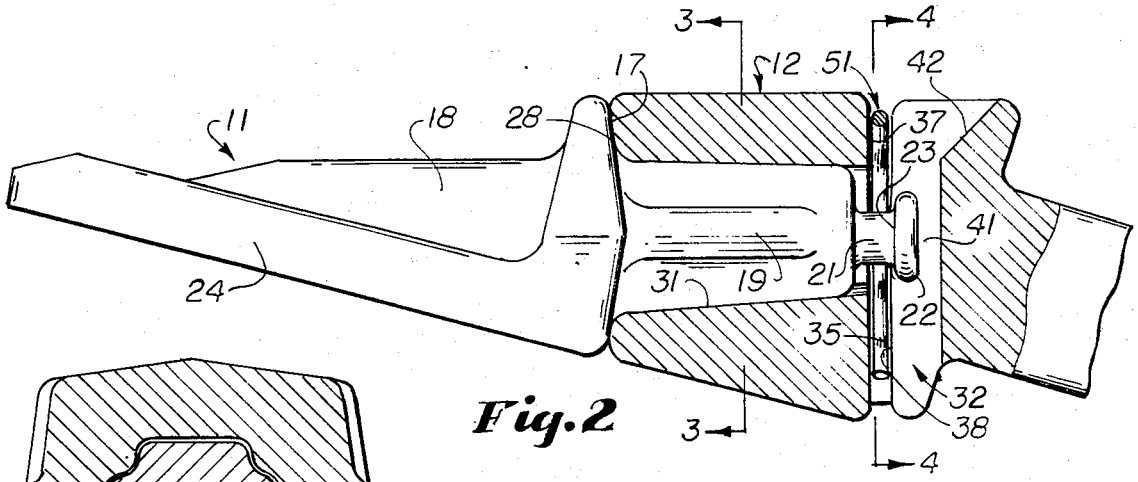
FIG. 2 is a longitudinal partially sectional view taken substantially along the line 2—2 of FIG. 1.

As best shown in FIGS. 1 and 2 in the middle of adapter 12 behind the button 22 is a rear extension 41 of the opening 32 and there is a slanted top surface 42. The rearward extension 41 serves several functions. It permits escape of earth within the recess 31. It permits a prying instrument, such as a screwdriver blade, to be inserted behind the button 22 to force the tooth 11 out of the adapter 12 when required. The slanted surface 42 enables a screwdriver blade to be inserted under the retainer 51 and used as a prying lever to raise the retainer 51 from operative to retracted positions.

Figure 5:
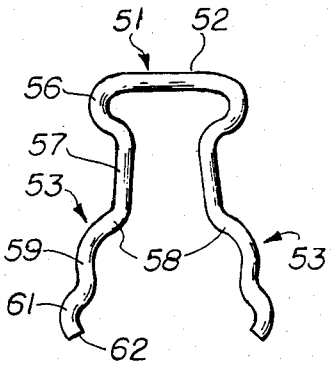
FIG. 5 is a front elevational view of the retainer of the present invention.

Retainer 51 is preferably fabricated from a single piece of round cross-section stainless steel such as #302. As best shown in FIG. 5, it has a top connector 52, which is generally horizontal, but slightly bowed upwardly. At either end of the top 52 are legs 53 which, in the preferred form of the invention, are preferably symmetric. Thus, proceeding from either end of top 52 is a reverse bend 56 which has a maximum width about equal to the width of opening 32. Below the reverse bend 56 is upper straight stretch 57 which is spaced from the opposing stretch 57 a distance greater than that of spindle 21, but less than the width of button 22, so that shoulder 23 is stopped by the straight stretches 57 to prevent removal of the tooth. The width across straight stretches 57 is less than the distance between the inner edges of projections 34. Below stretches 57 are outward-slanted stretches 58 which terminate in lower stretches 59 (shown straight) which are spaced apart about the width of opening 32 between side walls 33 of grooves 35. Below stretch 59 is lower outward-slanted stretch 61 which locks behind corner 63 formed by flared lower end 36 of the opening 32 intersecting side wall 33 in the operative position shown in FIG. 4. Below stretch 61 is an inward bend 62 which is rounded inward to facilitate insertion of the retainer 51 in the opening 32.

In use, either before the shank 19 of tooth 11 has been inserted into recess 31, or thereafter, initial installation of the retainer 51 is made. All that is required is to compress the initially diverging legs 53 toward each other sufficiently so that the lower slanted stretches 61 clear the projections 34. This is most easily accomplished by compressing the legs 53 with a pliers. Either of said legs 53 may be inserted in either of said grooves 35. When tooth 11 is to be locked into place, the operator taps the top connector 52 with a hammer, or by other means, depressing the retainer until it seats in the position shown in solid lines in FIG. 4. The outward slated stretches 61 lock against the outward flares 36, preventing unintentional dislodgment of the retainer 51. In this position, the upper straight sections 57 being located in front of the shoulder 53 of button 22 prevent the tooth 11 from being withdrawn from the adapter. As has previously been stated, the forces against the tooth 11 are transmitted directly from the shoulder 17 to the front edge 28 of retainer 12 and no part of this force is absorbed by the retainer 51. On the other hand, where there is a force tending to pull the tooth 11 away from the adapter 12, the straight stretches 57 of the retainer 51 prevent such movement. Since the latter forces are relatively small, the retainer 51 does not have to be of great strength.

When it is necessary to remove the tooth 11, the operator inserts the blade of the screwdriver under the top connector 52 and, by rocking downward, using the surface 42 as a fulcrum, the retainer 51 is pried upward sufficiently so that the button 52 clears the retainer. It is important to note that the projections 34 limit downward movement of the retainer 51 beyond the position shown in FIG. 4 and also limit upward movement so that the retainer is not unintentionally removed.

Figure 6:
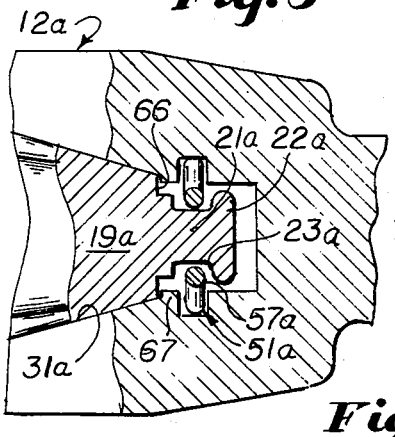
FIG. 6 is a fragmentary horizontal sectional view of a modification.

FIG. 6 shows a modification wherein any tendency of the inward bend of the retainer 51 to stick in the recess 31 instead of sliding in the opening 32 is prevented. Thus two vertical grooves 66 are cut in the distal end of shank 19*a*. Hence, the legs 53*a* of retainer 51*a* cannot enter opening 32*a*. In other respects, the elements of the modification of FIG. 6 resemble those of the preceding embodiment and the same reference numerals followed by the subscript a are used to designate corresponding parts.

What is claimed is:

1. In combination, a flat forged excavating tooth having a distal portion formed with a cutting point, said distal portion formed with a transverse first shoulder and a non-circular proximal portion, said proximal portion having a terminal button formed with a second shoulder and a reduced diameter spindle forward of said second shoulder, an adapter having a recess shaped to receive said proximal portion and said button and having a front edge bearing against said first shoulder to transfer the thrust on said tooth directly to said adapter, said adapter being formed with an opening having a pair of opposed straight walled grooves extending from a first face to the opposite second face of said adapter and each laterally offset from and communicating with said recess directly opposite said spindle and a projection in each said groove above said spindle extending inward toward said recess, the outside walls of said grooves being co-planar above and below said projections, and a reversible, round cross-secion, single piece resilient retainer, which is substantially co-planar and symmetric about its longitudinal center line, having an upwardly bowed top connector and a leg at either end depending from said connector and initially slanted outward, each said leg having a reverse bend joining said leg to said connector, an upper straight section opposite said spindle, an outward-downward slanted section, a lower section laterally-outwardly offset relative to said upper straight section and a lower terminal section, the width across said reverse bends and said lower sections being greater than the thickness of said button and the width across the upper straight sections being less than the distance between the inner edges of said projections, the distance between said upper straight sections being greater than said spindle and less than said button, said retainer being slidable in said grooves between a locked position with said upper straight sections straddling said spindle and an unlocked position with said lower sections opposite said spindle, said projections limiting movement of said retainer inward beyond locked position and outward beyond unlocked position by contacting said reverse bends and said outward-downward slanted sections, respectively, the opening in said grooves in said second face being formed with outward flares, each said retainer lower terminal section being curved outward to lock against one of said flares in the locked position of said retainer, each said lower terinal section being curved inward below the location where it is curved outward to facilitate initial insertion of said retainer legs into said grooves and past said projections, said retainer being positionable so that either of said legs may be inserted in either of said grooves.

2. The combination of claim 1 in which the width of said groove from front to rear is greater than the cross-section of said retainer so that said retainer is movable in said grooves from front to rear.

3. A reversible retainer for use in an excavating tooth and adapter assembly comprising a single piece of resilient round cross-section wire which is substantially co-planar and symmetric about its longitudinal center line having an upwardly bowed top connector and a leg depending from either end of said connector, said legs being initially slightly outwardly diverging, each said leg having a reverse bend joining said leg to said connector, an upper straight section below said reverse bend, an outwardly-downward slanted section below said upper straight section, a lower straight section below said outwardly-downward slanted section outwardly offset relative to said upper straight section and a lower terminal section, the width of said retainer across said reverse bends and said lower sections being greater than the width across said upper straight sections, said lower terminal sections being curved outward, the width of said retainer across said lower terminal sections being greater than the width across said lower straight sections, said lower terminal sections being curved inward below the location where they are curved outward.

* * * * *